United States Patent [19]

Fast

[11] Patent Number: 4,703,570

[45] Date of Patent: Nov. 3, 1987

[54] PRODUCT IDENTIFICATION TAGS

[76] Inventor: Jacob J. Fast, 7561 NW. 9th St., Plantation, Fla. 33317

[21] Appl. No.: 719,116

[22] Filed: Apr. 2, 1985

Related U.S. Application Data

[63] Continuation-in-part of Ser. No. 519,226, Aug. 2, 1983, Pat. No. 4,525,944, which is a continuation-in-part of Ser. No. 473,650, Mar. 9, 1983, Pat. No. 4,531,313.

[51] Int. Cl.[4] ..... G09F 3/18

[52] U.S. Cl. ..... 40/19.5; 40/124.1; 40/20 R

[58] Field of Search ..... 40/2 R, 124.1, 20, 19.5, 40/10 R, 617, 20 R

[56] References Cited

U.S. PATENT DOCUMENTS

| | | | |
|---|---|---|---|
| 1,005,894 | 10/1911 | Senseman | 40/2 X |
| 1,157,195 | 10/1915 | Ulrich | 40/10 R |
| 1,866,554 | 7/1932 | Fairbanks | 40/617 |
| 2,199,968 | 5/1940 | Flood | 40/25 |
| 2,305,426 | 12/1942 | Howell | 40/617 |
| 2,564,293 | 8/1951 | Ammon | 40/20 |
| 3,706,150 | 12/1972 | Greenberger | 40/124.1 X |
| 3,977,109 | 8/1976 | Berry, Jr. et al. | 40/124.1 |
| 4,351,440 | 9/1982 | Thalendfeld | 40/19.5 |
| 4,463,510 | 8/1984 | Windish | 40/2 R |
| 4,583,308 | 4/1986 | Taub | 40/19.5 |

FOREIGN PATENT DOCUMENTS

| | | | |
|---|---|---|---|
| 884536 | 12/1961 | United Kingdom | 40/2 |

*Primary Examiner*—Gene Mancene
*Assistant Examiner*—Wenceslao J. Contreras
*Attorney, Agent, or Firm*—Holman & Stern

[57] ABSTRACT

A product identification and display tag for use in connection with a product-suspending hook extending substantially horizontally from a support surface. The tag comprises first and second parts. The first part has a mounting portion for attachment to the hook adjacent the support surface, and an elongate portion extending from the mounting portion for overlying the hook. The second part of the tag comprises a display portion for hanging vertically at the forward end of the hook to receive a product information and identification label or the like. The second part of the tag is releasably attached to the first part by male and female connector elements so that when a label is to be replaced, with second part of the tag can be removed and replaced with another second part having a new label, thereby avoiding the need to replace the tag as a whole.

6 Claims, 10 Drawing Figures

PRODUCT IDENTIFICATION TAGS

CROSS REFERENCE TO RELATED APPLICATIONS

This application is a continuation-in-part of application Ser. No. 06/519,226, filed Aug. 2, 1983 now U.S. Pat. No. 4,525,944 for "Improved Product Identification Tag" which is itself a continuation-in-part of application Ser. No. 06/473,650, filed Mar. 9, 1983 now U.S. Pat. No. 4,531,313 for "Merchandise Information Tag With Improved Mounting Arrangement". The disclosures of both of the above applications are expressly incorporated herein by reference.

BACKGROUND OF THE INVENTION

The invention relates to product identification and information tags for merchandise suspended from elongate horizontally oriented support hooks and the like. More particularly, the invention relates to such tags which may be readily attached to and removed from the support hooks without being subject to inadvertent removal, and which display product information forwardly of merchandise supported on a hook.

My prior applications noted above disclose, inter alia, elongate product information and identification tags made of plastic sheet which display the product information forwardly of items suspended from horizontal hooks, which may extend, for example, from an apertured support board or the like. The tags include a mounting portion for attachment to and removal from the hook at a location adjacent the board, an intermediate portion extending forwardly from the mounting portion over the length of the hook and the merchandise suspended therefrom, and a display portion integrally formed at the distal end of the intermediate portion and which is bent downwardly in front of the hook for the display of required product identification and/or information data. Further, the tags disclosed in application Ser. No. 06/519,226 have an aperture adjacent the distal end of the intermediate portion for an end portion of the hook to project upwardly through, thereby providing lateral stabilization of the tag. When a product is removed from the hook over the front end, the tag flexes upwardly to free the end of the hook and the tag drops back over the end of the hook after the product has been removed.

Product identification and/or information data is commonly provided on an adhesive label which is applied to the display portion of the tag. If any of the information data, for example the product price, is to be changed, it is necessary either to remove the label, which may be difficult or impossible, or to stick a new label over the old one. In certain jurisdictions, however, this is illegal, so that the entire tag then has to be removed and replaced resulting in wastage of tags. Also, even where not illegal, the procedure may be subject to abuse by removal of the topmost label. Another problem which may arise, is that labels, if improperly applied, or labels having poor adhesive, may tend to become separated from the tag.

Accordingly, the present invention provides an identification tag structure intended to mitigate the above problems.

SUMMARY OF THE INVENTION

In accordance with the present invention a product identification or information tag generally of the kind disclosed in either one of the above noted prior patent applications is provided with a separate display portion for releasable attachment to and detachment from the distal or forward end of the intermediate portion of the tag.

In one form of the invention, for example, the display portion may comprise a plain sheet of plastic with at least one headed spear-like element on one edge and a fold line extending completely across the element adjacent said edge, the or each spear-like element releasably engaging into a corresponding transverse slit at the forward end of the intermediate portion of the tag, and the display portion being folded downwardly about the fold line. This form of display portion is intended primarily for use with adhesive type information and/or identification labels, so that when a new label is required, the display portion can simply be detached from the body of the tag and replaced by another one with the new label, rather than having to replace the entire tag.

In another form of the invention, the display portion is again formed from a plastic sheet with a spear-like projection or projections on one edge for engaging in a slit or slits in the intermediate portion of the tag, and with a fold line as aforesaid, but in this case the sheet is extended and folded to form a pocket or envelope to receive a non-adhesive product information and/or identification label.

In either form of the invention, a tag body may be provided with selectively usable display portions of different widths and/or heights, to suit different size labels.

Additional features and advantages of the invention will become apparent from the following description and claims read in conjunction with the attached drawings.

DESCRIPTION OF PREFERRED EMBODIMENTS

Figure 1:
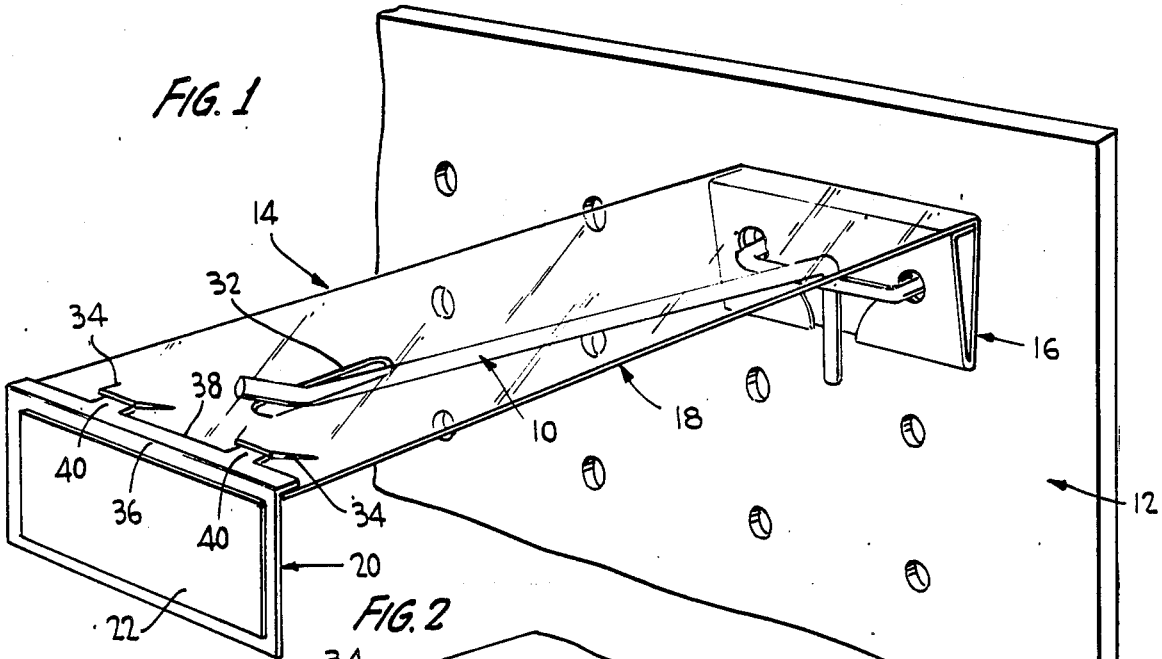
FIG. 1 is a perspective view of a product information and identification tag structure in accordance with the invention shown in combination with an elongate product-suspension hook.

Referring initially to FIG. 1, there is shown an elongate support hook 10 of a known type which extends substantially horizontally from an apertured board 12 for the display of a row of products suspended from the hook. As described in the prior applications previously referred to, the hook may have prongs (not shown) at its proximal end engaging in the board apertures to retain the hook in place. Further, a product identification and information tag 14 in accordance with the invention is provided to extend over the hook and provide identification and/or information data pertaining to products supported on the hook, such data being displayed at a location forwardly of the products.

Figure 4:
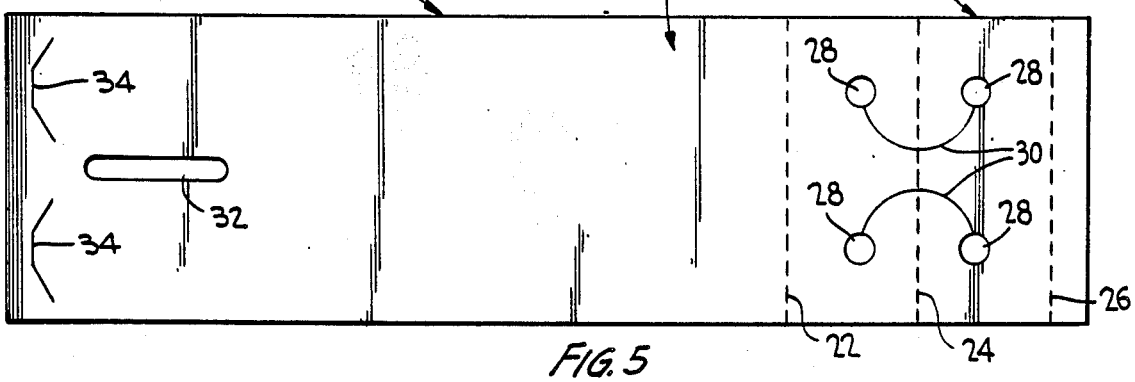
FIG. 4 is a plan view of a blank from which the body portion of the tag structure shown in FIG. 1 is formed.
Figure 5:
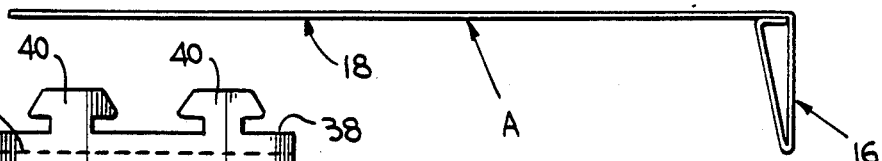
FIG. 5 is a side elevational view of the blank folded to form the body portion of the tag.

Tag 14 which is formed of plastic sheet has a mounting portion 16 at its rearward end for gripping onto the hook 10 at a location adjacent board 12, an elongate intermediate portion 18 extending from the mounting portion over the length of hook 10, and a display portion 20 at its forward or distal end beyond the end of the hook, which is bent down to receive an adhesive label 22, for example, inscribed with the product data. The construction of the tag is further illustrated in FIGS. 4 through 6 where it will be clearly seen that the tag as a whole is formed from two separate parts or blanks namely a first part A defining the mounting portion 16 and the intermediate portion 18, and a second detachable part or blank B defining the display portion 20.

Mounting portion 16 is formed by folding part A of the tag about bend lines 22, 24, 26 which are scored across part A in its manufacture. Further, the mounting portion is formed with die-cut holes 28 and connecting slits 30 whereby the mounting portion is clipped onto the back of the hook. A fuller description of this form of mounting portion is given in application Ser. No. 519,226, and it should here be noted that this particular mounting portion is shown herein by way of example only. Tags in accordance with the present invention can have different forms of mounting portion, for example to suit different types of hooks, and the present invention is primarily concerned with the construction of the forward or distal end of the tag. Thus, the tag may also have a specialized type of mounting portion as disclosed in my co-pending application titled "Product Identification Tag With Improved Mounting Portion" filed concurrently herewith and the contents of which is incorporated herein by reference.

As also described in detail in application Ser. No. 519.226, intermediate portion 18 of part A of the tag may be formed with an elongate die-cut aperture 32 for receiving the distal end of hook 10 and stabilizing the tag laterally. Forwardly of aperture 32, the intermediate portion of the tag is provided with a pair of three-part die-cut slits 34 adjacent its forward edge for the releasable attachment of part B of the tag in a manner to be described.

Figure 6:
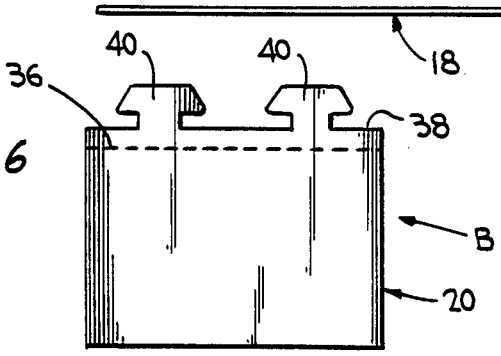
FIG. 6 is a plan view of a blank forming a display portion of the tag.

Part B of the tag, see particularly FIG. 6, comprises the aforementioned display portion 20 which terminates in bend line 36 scored across the entire width of part B adjacent its upper edge 38, and a pair of headed spear-like projections 40 on the upper edge. The projections each have a profile which is substantially complimentary, in reverse, to the profile of slits 34 in part A of the tag, so that the projections may be pushed into the slits to attach part B of the tag to part A and cannot readily be withdrawn except by laterally deforming the headed projections. When attached to part A, part B of the tag is folded down along bend line 36 to dispose display portion 20 vertically in front of hook 10 for receipt of label 22. When a new label is required, part B of the tag can be removed from part A by laterally deforming the headed projections 40 to remove them from slits 34, and inserting a replacement part B with the new label. Thus, the structure avoids the necessity of having to remove and replace the tag as a whole when a new label is required. Another advantage of the structure is that the double thickness at the front edge of the tag (i.e., the section of part B of the tag adjacent projections 40 overlying the front section of part A) adds stability to the front of the tab resisting sway when, for example, a bar code on the label is being read by a code reader.

Figure 2:
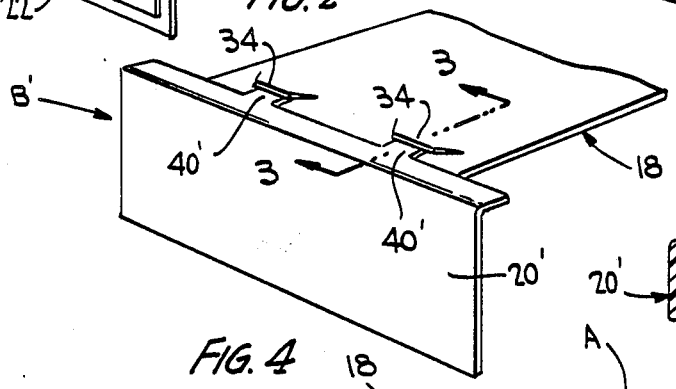
FIG. 2 is a perspective view of a front end part of a somewhat modified tag structure.
Figure 3:
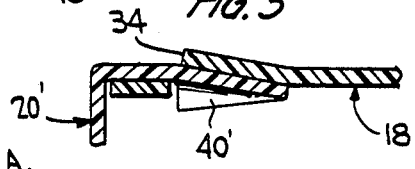
FIG. 3 is an enlarged sectional view on line 3—3 of FIG. 2.

As shown in FIGS. 1 and 6, the width of part B is substantially equal to the width of part A of the tag. However, for wider adhesive labels, the tag may also include a wider display portion 20' on a suitably dimensioned wider part B' as shown in FIG. 2, with projections 40' again dimensioned in conformity with slits 34.

Figure 7:
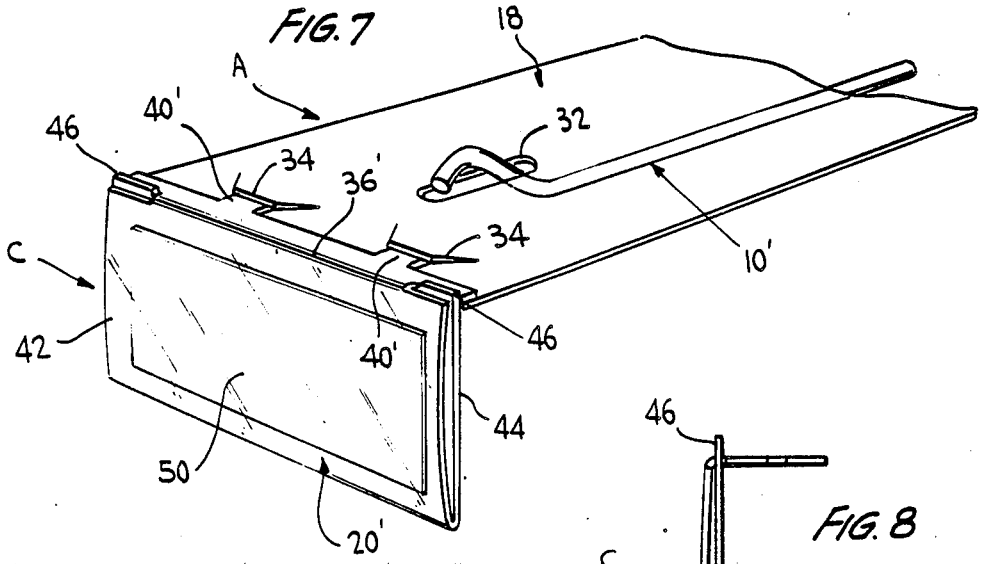
FIG. 7 is a perspective view similar to FIG. 1 of a further modified form of tag structure.
Figure 8:
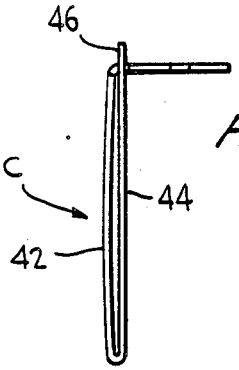
FIG. 8 is an elevational view of a display portion for the tag structure shown in FIG. 7.
Figure 9:
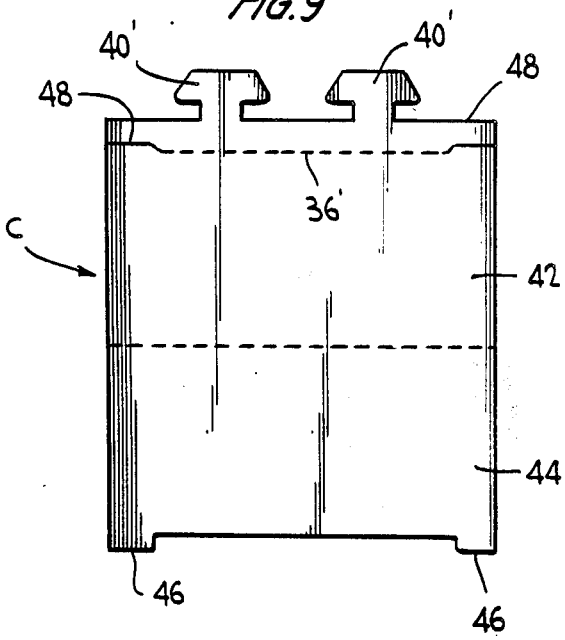
FIG. 9 is a plan view of a blank for forming the display portion.

FIGS. 7 to 9 illustrate a modified tag portion C for attachment to the front end of tag part A in place of the previously described parts B and B'. Thus, tag portion C comprises a pair of body panels 42, 44 with a central fold line, and tabs 46 at the distal end which fit into slits 48 associated with bend line 36' (conforming to bend line 36 of the tag parts B and B') so that part C can be folded to form a pocket or envelope-display portion 20' for receipt of a non-adhesive label 50. Tag part C has spear-like headed projections 40' conforming to projections 40 of the previous embodiments which fit into the slits 34 of tag part A in the manner previously described.

Figure 10:
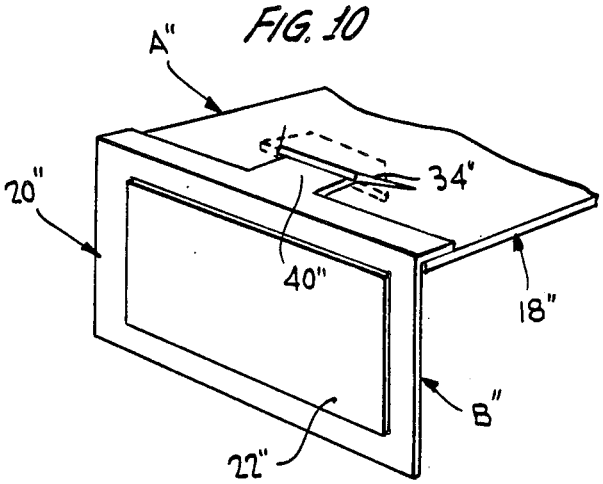
FIG. 10 is a perspective view similar to FIG. 3 showing a still further modified form of tag structure.

FIG. 10 shows still another embodiment of the invention wherein the forward end of tag part A" (conforming to part A of the previous embodiments) has only a single slit 34", and tag part B" (conforming to part B and part B' of the previous embodiments) has only a single headed spear-like projection 40" for releasable receipt therein. The single slit and single projection may be wider than each of the double slits and projections previously described and facilitates attachment and detachment of the respective tag parts.

While only preferred embodiments of the invention have been described herein in detail, the invention is not limited thereby and modifications can be made within the scope of the attached claims.

I claim:

1. In a product identification and information tag of sheet material for use in conjunction with an elongate hook projecting substantially horizontally from a support surface for suspending products thereon, the tag comprising a mounting portion for releasably attaching the tag to the hook adjacent said surface, an elongate intermediate portion extending from the mounting portion for overlying the hook, and a display portion at a distal end of the intermediate portion for displaying product information and/or identification data in a substantially vertically extending plane forwardly of the hook, the improvement comprising releasable attachment means between the display portion and the intermediate portion of the tag permitting removal and replacement of the display portion wherein the tag comprises a first part including said intermediate portion and a second part including the display portion, and a bend line across the second part defining a boundary of the display portion, the bend line being located adjacent one edge of said second part of the tag, and wherein the attachment means compises at least one male connector element extending from said one edge of the second part and a corresponding female connector element adjacent a forward edge of the intermediate portion of the tag, the spacing of said bend line from said one edge of the second part being related to the spacing of said female connector element from said forward edge of the intermediate portion for folding the display portion along said bend line forwardly of the display portion when the respective parts of the tag are mutually attached.

2. The invention of claim 1 wherein the male connector element comprises a headed spear-like projection on said one edge of the second part of the tag and the female connector element comprises a slit in the intermediate portion of the tag having a profile substantially corresponding to the profile of the projection in reverse.

3. The invention of claim 1 wherein the display portion of the tag is a plain sheet portion for receipt of an adhesive label.

4. The invention of claim 1 wherein the display portion of the tag comprises an envelope portion for receipt of a non-adhesive label.

5. The invention of claim 4 wherein the envelope portion comprises a first panel extending from said bend line to a fold line extending across the second part of the tag, a second panel extending from the fold line to another edge of the second part and tab means on said another edge for engagement in corresponding slit means associated with the bend line to form the envelope portion.

6. The invention of claim 1 including an aperture in the intermediate portion of the tag rearwardlly of the female connector element for receiving the distal end of the hook.

* * * * *